US008578744B2

(12) United States Patent
Yu et al.

(10) Patent No.: US 8,578,744 B2
(45) Date of Patent: Nov. 12, 2013

(54) LOCK STRUCTURE FOR ELECTRONIC DEVICE

(75) Inventors: Chang-Chiang Yu, New Taipei (TW); Chun-Sheng Wu, New Taipei (TW)

(73) Assignee: Sinox Co., Ltd., Zhonghe District, New Taipei (TW)

( * ) Notice: Subject to any disclaimer, the term of this patent is extended or adjusted under 35 U.S.C. 154(b) by 0 days.

(21) Appl. No.: 13/340,133

(22) Filed: Dec. 29, 2011

(65) Prior Publication Data

US 2012/0167647 A1 Jul. 5, 2012

Related U.S. Application Data

(60) Provisional application No. 61/428,049, filed on Dec. 29, 2010.

(51) Int. Cl.
*E05B 65/00* (2006.01)

(52) U.S. Cl.
USPC ..... 70/58; 70/14; 70/312

(58) Field of Classification Search
USPC ..... 70/14, 58, 57, 312, 30, 49
See application file for complete search history.

(56) References Cited

U.S. PATENT DOCUMENTS

| | | | | |
|---|---|---|---|---|
| 5,327,752 | A * | 7/1994 | Myers et al. | 70/58 |
| 6,058,744 | A * | 5/2000 | Ling | 70/28 |
| 6,619,081 | B1 * | 9/2003 | Yu | 70/58 |
| 6,880,373 | B2 * | 4/2005 | Ling | 70/58 |
| 6,968,716 | B1 * | 11/2005 | Ling | 70/14 |
| 6,973,809 | B2 * | 12/2005 | Chang | 70/58 |
| 7,111,479 | B2 * | 9/2006 | Murray et al. | 70/58 |
| 7,140,210 | B2 * | 11/2006 | Cheng | 70/58 |
| 7,401,481 | B1 * | 7/2008 | Lin | 70/14 |
| 7,409,842 | B2 * | 8/2008 | Kuo | 70/58 |
| 8,001,812 | B2 * | 8/2011 | Mahaffey et al. | 70/58 |
| 8,042,366 | B2 * | 10/2011 | Mahaffey et al. | 70/58 |
| 2006/0081021 | A1 * | 4/2006 | Merrem et al. | 70/58 |
| 2006/0288745 | A1 * | 12/2006 | Murray et al. | 70/58 |
| 2007/0074547 | A1 * | 4/2007 | Wu | 70/58 |
| 2007/0220931 | A1 * | 9/2007 | Murray et al. | 70/58 |
| 2009/0049876 | A1 * | 2/2009 | White et al. | 70/58 |
| 2010/0192642 | A1 * | 8/2010 | Hung et al. | 70/58 |
| 2010/0263414 | A1 * | 10/2010 | Andres et al. | 70/58 |
| 2012/0006080 | A1 * | 1/2012 | Yu et al. | 70/58 |
| 2012/0125057 | A1 * | 5/2012 | Mahaffey et al. | 70/14 |
| 2012/0227448 | A1 * | 9/2012 | Su | 70/58 |
| 2012/0312056 | A1 * | 12/2012 | Yu et al. | 70/14 |

* cited by examiner

*Primary Examiner* — Suzanne Barrett

(74) *Attorney, Agent, or Firm* — Muncy, Geissler, Olds & Lowe, PLLC

(57) ABSTRACT

A lock structure for an electronic device includes a housing, a securing element, an entering portion, and a lock body. The housing has a cavity and a first through hole. The securing element has a retaining portion and an extension portion extending out of the housing by the first through hole and together forming a T-shaped structure, wherein the retaining portion has a length and a width. The entering portion is capable of moving back and forth with respect to the housing and the securing portion, and is parallel to an axis of the extension portion. When the lock body is in an unlocked status, the entering portion is moveable along the extension portion; when the lock body is in a locked status, the entering portion extends out of the housing and is fixed beside the extension portion.

17 Claims, 6 Drawing Sheets

LOCK STRUCTURE FOR ELECTRONIC DEVICE

This application claims priority of U.S. Provisional Application No. 61/428,049 filed on Dec. 29, 2010 under 35 U.S.C. §119(e), the entire contents of all of which are hereby incorporated by reference.

BACKGROUND OF THE INVENTION

1. Field of the Invention

The present invention generally relates to a lock structure. Particularly, the present invention relates to a lock structure for securing an electronic device.

2. Description of the Prior Art

Consumer electronic products have played an important role in modern life; moreover, because of fast modern lifestyle and the demand for instant information, portable electronic products have become one of the essentials for people. However, because of higher unit price and easy realizable characteristics, the possibility of portable electronic products being stolen accordingly increases.

To prevent from thieves, a lock structure had been developed, such as the notebook lock, which can connect an opening or a lock hole of electronic products through its lock fastener. The lock fastener is further controlled by a lock mechanism to accomplish the locking/unlocking operation. However, when using the lock mentioned above to secure an electronic product, it is required to insert the key into the key hole to control the lock fastener or to operate unlocking/locking of the lock body; on the other hand, the unlocking or locking operation may require both hands to simultaneously operate the lock structure. Therefore, the lock structure for electronic product can be improvable in operation or design.

SUMMARY OF THE INVENTION

It is an object of the present invention to provide a lock structure to work with a key to provide a burglarproof function for expensive items such as electronic devices.

It is another object of the present invention to provide a lock structure, which is easy to operate a locking operation.

The present invention provides a lock structure to work with a key. The lock structure includes a housing, a lock body, an operation device, a driving device, a movable connecting unit having an entering portion, and a securing element. The housing has a first through hole formed thereon. The entering portion includes, for example, two columnar structures spaced apart from each other. The entering portion is capable of moving back and forth with respect to the housing and the securing element through the first through hole to retreat back to the housing or extend out of the housing, i.e. being in or out of the housing. The securing element has an extension portion passing through the first through hole; a retaining portion is formed on one end of the extension portion to form a T-shaped structure with the extension portion. The lock structure connects to the electronic device by means of the T-shaped structure. The lock body is connected to the driving device. When the lock body is in an unlocked status, a restriction in a locked status to the driving device is released. The action of the driving device further drives or causes the connecting unit and the entering element thereof to move, wherein the entering portion moves out from the cavity through the first through hole and moves along the extension portion in an axial direction; alternatively, the entering portion moves along the extension portion and return back to the cavity through the first through hole. In addition, the lock body is connected to an operation device.

When the lock body is in the unlocked status, the operation device is operable; moreover, when operating the operation device, the operation device activates the driving device to drive the entering portion to move out through the first through hole, move along the extension portion of the securing element in the axial direction to partially or completely extend out of the housing, and selectively enter the lock hole. When the operation is completed, the lock body is in the locked status; correspondingly, the movements of the driving device and the entering portion are completed. Consequently, the two columnar structures of the entering portion are fixed at opposite sides of the extension portion so that the securing element is secured to the lock hole. In addition, the operation device is restrained from being operable.

That is, when the lock body is in the unlocked status, the T-shaped structure of the securing element can enter the lock hole or leave the lock hole; furthermore, when the T-shaped structure is in the lock hole, it is able to rotate the lock structure to let it revolve on its own axis by ninety degrees, so that the retaining portion of the securing element is blocked by a wall around the lock hole. Afterwards, the operation device is operated to drive the driving device to make the entering portion move out through the first through hole and move along the extension portion of the securing element, finally entering the lock hole, so that the two columnar structures of the entering portion are positioned beside the extension portion respectively at opposite sides. When the operation is finished and the lock body is in the locked status, the entering portion is inserted into the lock hole and restricts the rotation of the lock structure, so that the T-shaped structure of the securing element cannot be removed from the lock hole; that is, the securing element is secured to the lock hole and the lock structure cannot be detached from the electronic device. The operation device and the lock body can be different portions of the lock structure; alternatively, the lock body itself can serve as the operation device.

On the contrary, when performing an unlocking operation on the lock body in the locked status as mentioned above, the restriction in a locked status to the driving device is released, further resulting in a displacement of the connecting unit in an axial direction; meanwhile, the entering portion selectively leaves the lock hole and simultaneously moves along the extension portion of the securing element in the axial direction, then finally returns back to the cavity through the first through hole. Consequently, the extension portion without the entering portion being positioned at opposite sides thereof allows the lock structure to be rotated in order to allow the securing element, without the retaining portion blocked by the wall around the lock hole after rotation, to leave the lock hole, so that the lock structure is released from the securing of the electronic device.

DETAILED DESCRIPTION OF THE PREFERRED EMBODIMENT

Figure 1A:
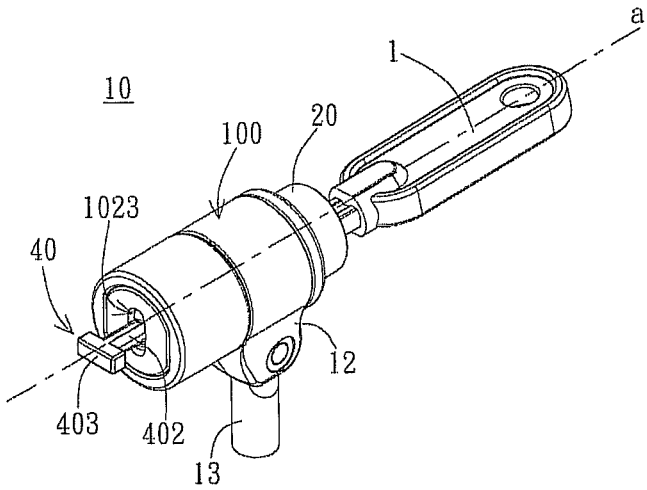
FIGS. 1A-1C are perspective views of the embodiment of the present invention.
Figure 1B:
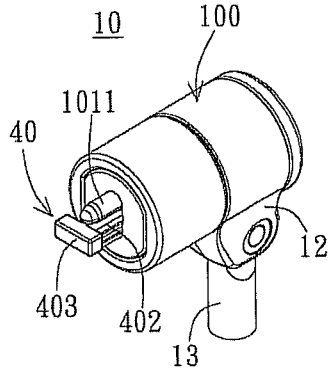
Figure 1C:
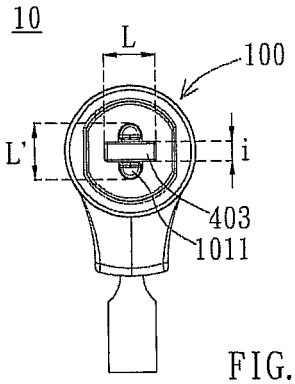

The present invention provides a lock structure for an electronic device. In preferred embodiments, the electronic device can be any electronic device that has at least a lock hole such as, but is not limited to, laptops or notebooks. As FIGS. 1A-1B show, the lock structure 10 includes a housing 100, a lock body 20, an operation device (not shown), a driving device (not shown), a moveable connecting unit having an entering portion 1011, and a securing element 40, wherein the housing 100 encloses at least a cavity or has an interior space for accommodating at least a portion of the lock body 20, the operation device, the driving device, and the securing element 40. Furthermore, a flexible chain/cable 13 can be connected to the housing 10 for securing the electronic device to a stationary object such as a table. One end of the housing 100 has a first through hole 1023 formed thereon to communicate with the cavity. The entering portion 1011 can move back and forth with respect to the housing 100 and the securing element 40 through the first through hole 1023. That is, the entering portion 1011 can move along the securing element 40 through the first through hole 1023 so that extending out of the housing 100 or being received in the housing 100. Particularly, the entering portion 1011 moves substantially parallel to an axis, i.e. the longitudinal axis of the extension portion 402, which is substantially the same with an axis a of the lock structure 10, to extend out of the housing 100 or return back to the cavity of the housing 100 through the first through hole 1023. The entering portion 1011 includes two columnar structures spaced apart from each other, wherein the two columnar structures can be, for example, two opposite semi-circular columns separated from a circular column and configured to restrict one-dimensional movement. The securing element 40 has a settling portion 401, an extension portion 402, and a retaining portion 403, wherein the extension portion 402 passes through the first through hole 1023 and extends out of the housing 100; the retaining portion 403 is formed on one end of the extension portion 402 protruding out of the housing 100; the extension portion 402 and the retaining portion 403 together can form a T-shaped structure. In addition, the shape of the retaining portion 403 corresponds to the shape of the lock hole of the electronic device while a length of the extension portion 402 is greater than the thickness of a wall around the lock hole, wherein the lock hole usually has a rectangular shape, but is not limited thereto. As FIG. 1C shows, the retaining portion 403 corresponding to the lock hole has a rectangular cross section with a length L and a width i, wherein the length L is greater that the width i. When the entering portion 1011 moves out of the housing 100 from the first through hole 1023, the entering portion 1011 moves along the longitudinal direction of the extension portion 402 to an adequate/predetermined position so that the two columnar structures of the entering portion 1011 are positioned on two opposite sides of the extension portion 402 along the longitudinal direction of the extension portion 402. Accordingly, a direction of a virtual connecting line of the two columnar structures is preferably parallel to the extension direction of the width i and perpendicular to the extension direction of the length L. In addition, the length L' between two furthest outer edges of the two columnar structures in the virtual connecting line is preferably close to the length L, and more preferably equal to the length L (described later).

Figure 2A:
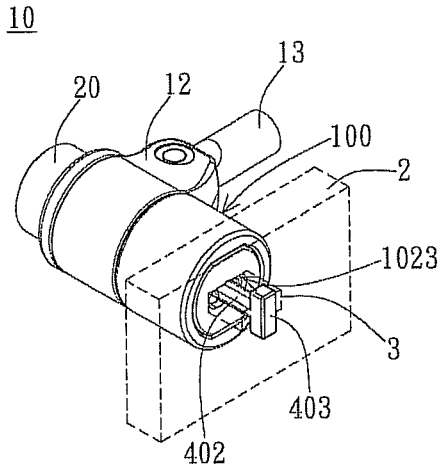
FIG. 2A-2B are perspective views of the embodiments of the present invention.
Figure 2B:
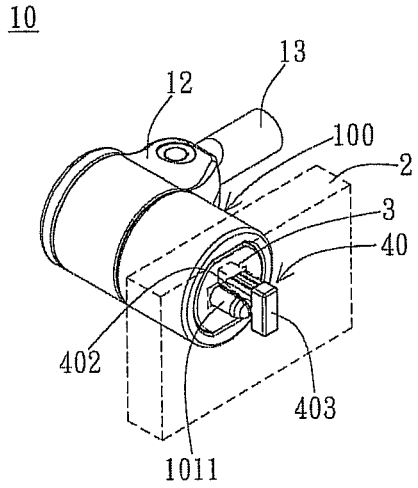

The T-shaped structure of the securing element 40 of the lock structure 10 can enter into or leave the corresponding lock hole, wherein the retaining portion 403 is firstly inserted into or detached from the lock hole with entering portion 1011 preferably being received within the housing 100. When the retaining portion 403 has been inserted into the lock hole, rotating the lock structure 10 about its own axis by an angle in a range of zero to one hundred eighty degrees, preferably ninety degrees, will make the retaining portion 403 within the lock hole rotate accordingly to a position not corresponding to the lock hole, so that the inner face of the wall around the lock hole blocks the T-shaped structure of the securing element 40 from leaving the lock hole by touching against the retaining portion 403. As FIGS. 2A-2B show, when the retaining portion 403 has been inserted into the lock hole 3, the lock structure 10 revolving on its own axis by ninety degrees makes the retaining portion 403 not correspond to the lock hole 3, i.e. the rectangular shape of the retaining portion 403 is not aligned with the rectangular shape of the lock hole. On the other hand, portions of the lock hole 3 at opposite sides of the extension portion 402 are exposed, as shown in FIG. 2A. As such, a virtual connecting line of the exposed portions of the lock hole 3 is parallel to the extension direction of the width i of the retaining portion 403 and perpendicular to the extension direction of the length L (please refer to FIG. 1C). Meanwhile, the entering portion 1011 that can move along the extension portion 402 in and out of the housing 100 through the first through hole 1023 can enter the partially exposed lock hole 3; as a result, the two columnar structures of the entering portion 1011 corresponding respectively to the exposed portions of the lock hole 3 at opposite sides of the extension portion 402 are inserted into the lock hole 3. The two columnar structures of the entering portion 1011 are finally positioned on two opposite sides of the extension portion 402 and block the above-mentioned partially exposed lock hole 3. Consequently, the entering portion 1011 in the lock hole 3 restricts the rotation of the lock structure 10 as well as the rotation of the retaining portion 403 to a position allowing the T-shaped structure to leave the lock hole 3, i.e. a position that the rectangular shape of the retaining portion 403 is aligned with the rectangular shape of the lock hole 3. In addition, it is notable that an extent to which the entering portion 1011 extends out is that the entering portion 1011 is at least partially in the lock hole 3; that is, it is not necessary that the entering portion 1011 extends out at least as long as the depth of the lock hole 3 is; consequently, the entering portion 1011 may not have to return back completely to the cavity completely while the T-shaped structure of the securing element 40 still can leave the lock hole, as long as the entering portion 1011 is not in the lock hole 3 at all. On the other hand, the entering portion 1011 being inserted into the lock hole 3 may not have to block the partially exposed lock hole 3 completely; consequently, the length L' between two furthest outer edges of the two columnar structures in the virtual connecting line may be smaller than the length L while greater than the width i of the retaining portion 403. However, in the preferred embodiment of the present invention, the entering portion 1011 can substantially blocks the partially exposed lock hole 3 completely when being inserted into the lock hole 3, and can extend out to an extent that the entering portion 1011 extends out at least as long as the depth of the lock hole 3 is.

As mentioned above, the entering portion 1011 in the lock hole 3 restricts the rotation of the lock structure 10 as well as the rotation of the retaining portion 403 to a position allowing the T-shaped structure to leave the lock hole 3; in other words, the retaining portion 403 of the securing element 40 is engaged with and secured in the lock hole 3. In sum, in cooperation with the entering portion 1011, the T-shaped structure of the securing element 40 is selectively engaged with and secured in the lock hole 3 to secure the electronic device to a stationary object. It is noted that although the entering portion 1011 of the embodiment is illustrated as two columnar structures, in other embodiments, the entering portion 1011 can be any number of any appropriate shaped structure provided that the entering portion 1011 can move back and forth to reveal or block the lock hole with the extension portion 402, allowing or restricting the rotation of the lock body and the T-shaped structure of the securing element 40 within the lock hole. The structure and movement relationships among the housing 100, the lock body 20, the operation device, the driving device, and the securing element 40 will be described later.

Figure 3:
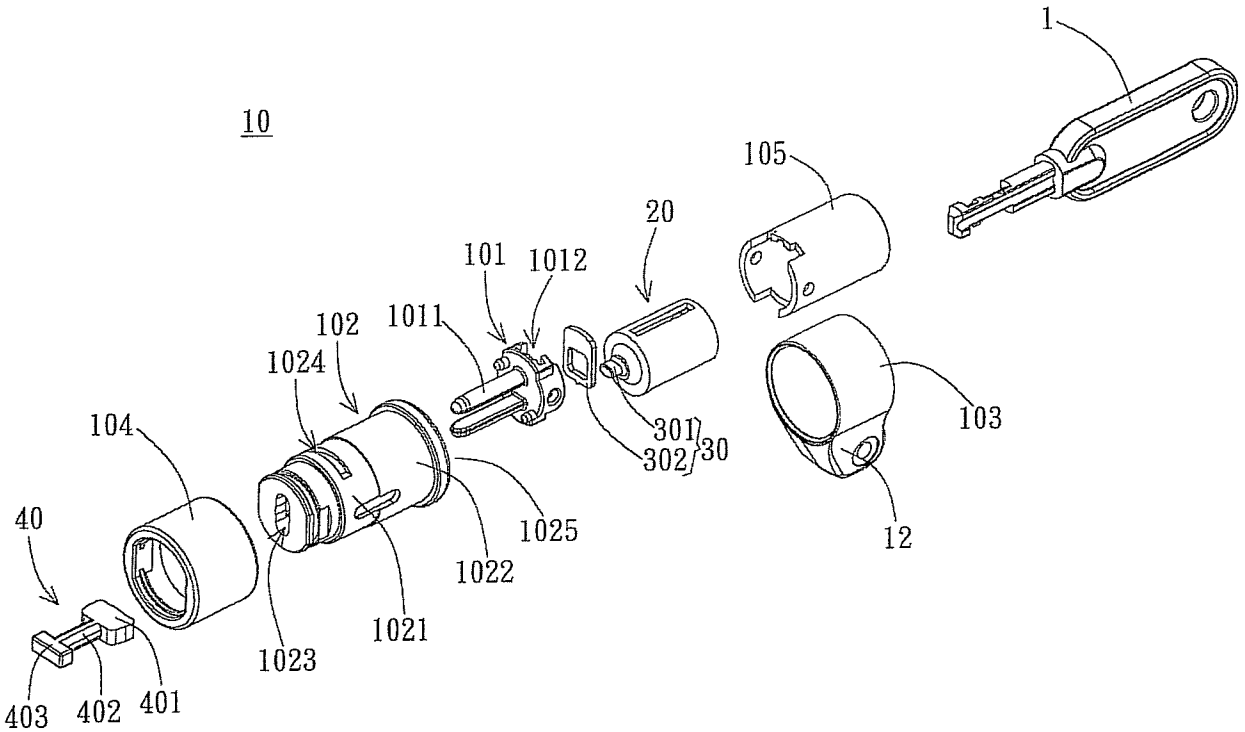
FIG. 3 is a perspective view of the embodiment of the present invention.

An exploded view of the embodiment is shown in FIG. 3. As FIG. 3 shows, the housing 100 is preferably composed of several housing parts. For example, the housing 100 includes an inner housing part 102, a first housing part 103, and a second housing part 104 connected to each other to form the cavity for accommodating other components of the lock structure 10. A lock body housing 105 is further provided for covering the lock body 20. In the preferred embodiment, the inner housing part 102 includes a first portion 1021 having a greater tube diameter and a second portion 1022 having a smaller tube diameter, wherein the first portion 1021 has the first through hole 1023 formed thereon, by which the entering portion 1011 moves in and out of the housing 100. In addition, a second through hole 1024 (described later) is also formed on the first portion 1021. The second portion 1022 has an opening 1025 formed thereon. Furthermore, there is a plurality of holes including a restraining hole for the positioning the components accommodated in the cavity and/or allowing the components to have limited movements and/or rotations. Consequently, the first housing part 103 mentioned above surrounds the inner housing part 102 to cover the holes of the inner housing part 102 and the portions of the components exposed in the holes so that the components will not be exposed. In addition, for example, a protrusion 12 is formed or disposed on the first housing part 103 to connect to the flexible chain/cable. Following the first housing part 103, the second housing part 104 also surrounds the inner housing part 102 and is adjacent to the first housing part 103. The connection of the protrusion 12 of the first housing part 103 and the flexible chain/cable can be accomplished by any prior arts such as ways of riveting.

A connecting unit 101 is disposed in the cavity enclosed by the inner housing part 102 and can have a displacement in the axial direction therein. In addition, the entering portion 1011 is formed on one side of the connecting unit 101 for the lock structure 10 connecting to the electronic device. When the connecting unit 101 displaces axially, i.e. displaces in the axial direction of the lock structure 10 in the cavity, the entering portion 1011 formed thereon displaces accordingly to move out of the housing 100 or return back to the housing 100 through the first through hole 1023 formed on the first portion 1021 of the inner housing part 102. The shape and the size of the first through hole 1023 are designed based on the entering portion 1011. For example, as the above mentioned, the entering portion 1011 is two columnar structures spaced apart from each other; the first through hole 1023 is therefore designed based on the two columnar structures. In the preferred embodiment of the invention, the first through hole 1023 has an elongated shape due to the overall shape of the entering portion 1011. Furthermore, in addition to the entering portion 1011, the elongated through hole 1023 enables the extension portion 402 of the securing element 40 to pass through, wherein the two columnar structures of the entering portion 1011 are positioned beside the extension portion 402 respectively at the opposite sides thereof, as mentioned above. The securing element 40 is disposed at the side of the connecting unit 101 having the entering portion 1011 formed thereon. The securing element 40 includes the settling portion 401, the extension portion 402, and the retaining portion 403, wherein the settling portion 401 and a small portion of the extension portion 402 are located in the cavity, a great portion of the extension portion 402 extending out from the first through hole 1023 together with the retaining portion 402 are located outside the housing 100. By means of the setting portion 401, the securing element 40 can be fixed to the inner side of the housing 100. While the entering portion 1011 mentioned above displaces axially, the entering portion 1011 also moves relative to the securing element 40, particularly along the extension portion 402. The connection of the connecting unit 101, the inner housing part 102, the first housing part 103, and the second housing part 104 can be accomplished by any prior arts such as engagement, adhering, or fastening.

In addition, a portion of the lock body 20 is accommodated in the cavity, wherein the lock body 20 is, for example, a key lock and has a key hole exposed to outside. When a user uses a key to unlock the lock body 20, the operation device mentioned above will enter a first status, and the driving device 30 which is restricted by the lock body 20 in a locked status will be released so that the connecting unit 101 displaces in the axial direction, i.e. away from the securing element 40. The entering portion 1011 of the connecting unit 101 therefore moves along the extension portion 402 of the securing element 40 and selectively retreats from the lock hole. Finally, the entering portion 1011 may return back to the cavity through the first through hole 1023. Afterwards, after the lock structure 10 being rotated, the T-shaped structure of the securing element 40 may leave the lock hole or selectively enter the lock hole. The first status mentioned above is a status in which, for example, the operation device can be pressed. On the other hand, when the user operates the operation device in the first status, i.e. presses the operation device, the pressed operation device will drive simultaneously the driving device 30, which is released in the unlocked status, to move and drive the connecting unit 101 to displace in the axial direction, i.e. move toward the securing element 40. The entering portion 1011 extending out of the housing 100 from the first through hole 1023 and simultaneously moves along the extension portion 402. After the completion of locking operation by pressing and operating the lock body 20, the operation device is in a second status; meanwhile, the driving device 30 and the connecting unit 101 also complete the moving or displacing action and remain at the position after the movement or displacement. On the other hand, the entering portion 1011, which moves along with the displacement of the connecting unit 101, selectively enters the lock hole and is fixed at opposite sides of the extension portion 402. Consequently, since the entering portion 1011 and the retaining portion 403 are confined within the lock hole, the lock structure 10 is not rotatable to let the securing element 40 leave the lock hole; in other words, the securing element 40 is secured in the lock hole. The second status mentioned above is a status in which, for example, the operation device cannot be pressed. The operation and mechanism thereof of the lock body 20 are known by a skilled person and not elaborated hereinafter. In the preferred embodiment of the present invention, the operation device is disposed on the lock body 20; in other words, the lock body 20 itself also serves as the operation device. Accordingly, the unlocking operation simultaneously enables the lock body/operation device 20 enter the unlocked status, i.e. the first status. On the contrary, pressing the operation device/lock body 20 is equal to performing the locking operation. The completion of pressing action is equal to the completion of the locking operation, allowing the operation device/lock body 20 to enter the locked status, i.e. the second status. The connection between the driving device 30 and other components of the lock structure 10 will be described later.

Figure 4A:
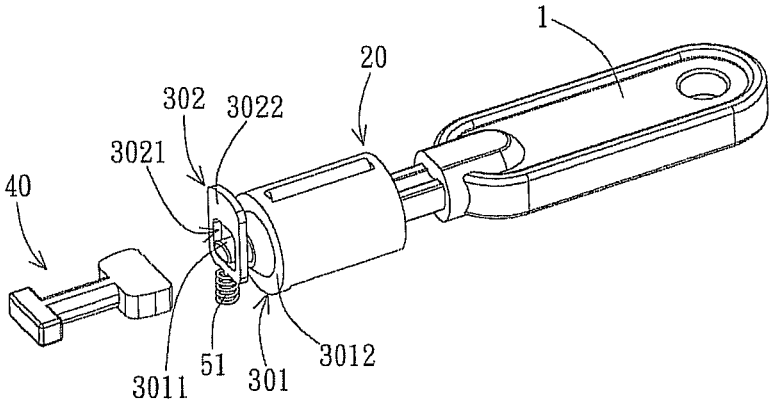
FIGS. 4A-4B are perspective views of the embodiment of the present invention, wherein part of the components of the lock structure including the housing are removed.
Figure 4B:
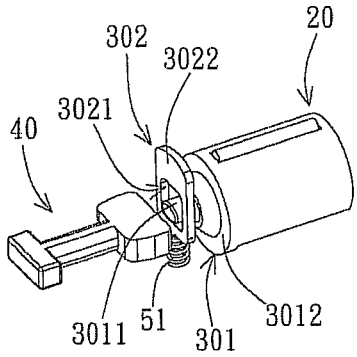

As FIG. 3 and FIGS. 4A-4B show, the driving device 30 is connected with the lock body 20 and is adjacent to the connecting unit 101, wherein the lock body 20 and the connecting unit 101 are at opposite sides of the driving device 30. The lock body 20 includes a lock core (not shown) and the key hole mentioned above. In the preferred embodiment of the present invention, the lock body 20 also serves as the operation device, as mentioned above, wherein the lock body/operation device 20 can move in the axial direction. The driving device 30 is accommodated in the cavity and includes a driving portion 301 and a restricting element 302, wherein the driving portion 301 is disposed on the lock body/operation device 20. In the preferred embodiment of the present invention, as FIGS. 4A-4B show, the driving portion 301 has a columnar structure with an elliptical cross section, preferably an eccentric column with such an elliptical cross section 3011, which can rotate around a spindle rather than its axis. The restricting element 302 is a frame-like structure 3021, which is movably fitted to the eccentric column with the elliptical cross section 3011 and contacts part of the eccentric column, wherein an axis of the eccentric column, which is preferably the longitudinal axis perpendicular to the elliptical cross section 3011, is perpendicular to a plane on which the frame-like structure 3021 lies. In addition, the restricting element 302 includes a flat portion 3022 extending from one side of the frame-like structure 3021, wherein it is preferred that the flat portion 3022 extends toward a direction in which the restricting element 302 selectively moves back and forth. When rotating the key to unlock the lock body/operation device 20, the eccentric column with an elliptical cross section 3011 simultaneously rotates. During the rotation, the eccentric column 3011 displaces to drive the frame-like structure 3021 of the restricting element 302 so that the restricting element 302 is removed from a restricting position (described later), wherein the restricting position is the position that the restricting element 302 is located when the lock body/operation device 20 is in the locked status. On the other hand, as mentioned above and shown in FIGS. 5A-5B, the driving device 30 (please refer to FIG. 3) is adjacent to the connecting unit 101, wherein a trough is formed on the side of the connecting unit 101 adjacent to the driving portion 301. An opening 1012 of the trough selectively corresponding to a second through hole 1024 is formed on the inner housing part 102. The trough is for the restricting element 302 being received therein and coupling with the connecting unit 101, wherein the flat portion 3022 of the restricting element 302 corresponds to the opening 1012. In addition, the restricting element 302 received therein can independently have a limited displacement in a radial direction so that the flat portion 3022 moves relative to the opening 1012; accordingly, the flat portion 3022 may therefore leave/enter the restricting position (described later). The driving portion 301 of the driving device 30 further includes a platform 3012, which is at one side of the connecting unit 101 and connects with the connecting unit 101. As a result, when pressing the lock body/operation device 20 in the first status, the platform 3012 of the driving portion 301 on the lock body/operation device 20 pushes the connecting unit 101 and the restricting unit 302 therein to displace toward the restricting position; when finishing pressing, the flat portion 3022 of the restricting element 302 enters the restricting position while the lock body/operation device 20 is in the locked status.

Figure 5A:
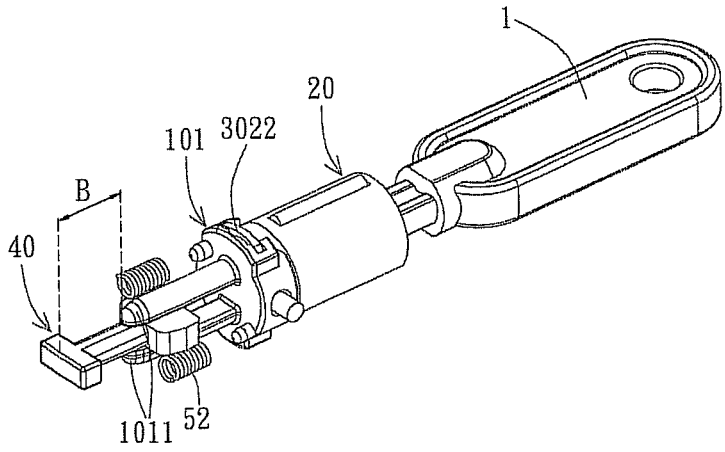
FIG. 5A-5B are perspective views of the embodiment of the present invention; wherein part of the components of the lock structure including the housing are removed.
Figure 5B:
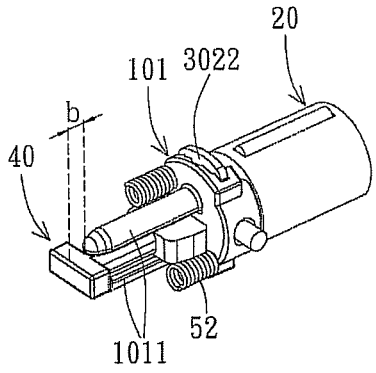
Figure 6A:
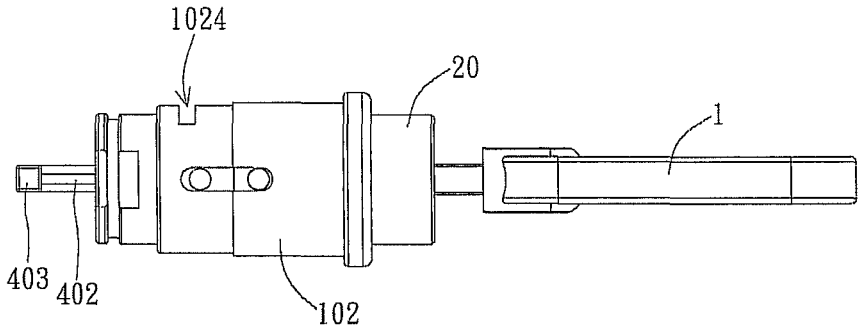
FIGS. 6A-6B are perspective views of the embodiment of the present invention, wherein part of the components of the lock structure including the housing are removed.
Figure 6B:
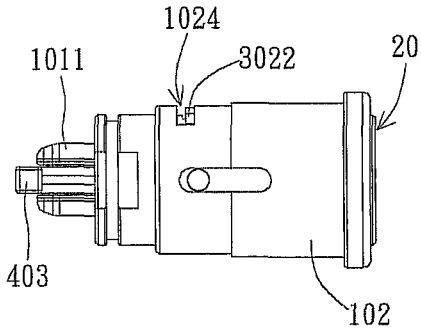

Please refer to FIGS. 5A-5B and 6A-6B. As FIGS. 5B and 6B show, in the locked status, the flat portion 3022 of the restricting element 302 extends to the second through hole 1024 through the opening 1012, which is aligned with the second through hole 1024. The flat portion 3022 is restrained by a wall of the inner housing part 102 defining the second through hole 1024. As a result, the restricting element 302 is at the restricting position. Meanwhile, the lock body/operation device 20 in the locked status is also in the second status, in which the lock body/operation device 20 cannot be pressed. On the other hand, as FIGS. 5A and 6A show, when performing an unlocking operation, namely inserting the key 1 and rotating the lock body/operation device 20, the restricting element 302 is driven by the eccentric column with an elliptical cross section 3011 and leaves the restricting position by moving away from the second through hole 1024 in the radial direction, i.e. in a direction toward the cavity. Meanwhile, the restricting element 302 together with the connecting unit 101 are pushed by an elastic element 52 and displaces away from the securing element 40 in the axial direction (a distance of the displacement is B-b). Consequently, the unlocking operation allows the flat portion 3022 of the restricting element 302 to be received in the cavity and not restrained by the wall of the inner housing part 102 defining the second through hole 1024. In addition, the lock body/operation device 20 is in the unlocked status, i.e. the first status, in which the lock body/operation device 20 can be operably pressed.

In view of the discussions set forth above, the restricting element 302 of the driving device 30 and the connecting unit 101 are combined together, so that the restricting element 302 and the connecting unit 101 together can displace in the axial direction. Moreover, the restricting element 302 can displace in the radial direction by itself, wherein the displacement of the restricting element 302 in the radial direction can effect the displacement of the restricting element 302 and the connecting unit 101 in the axial direction. Particularly, the radial displacement of the restricting element 302 is resulted from either driving the driving portion 301 during the unlocking operation or a force provided by an elastic element 51 at a relative position. During the unlocking operation, the driving portion 301 drives the flat portion 3022 to retreat from the second through hole 1024 so that the restricting element 302 is released from the restricting position; on the contrary, during the locking operation, the force provided by the elastic element 51, which is disposed at the side of the frame-like structure 3021 opposite to the side at which the flat portion 3022 is disposed, pushes the restricting element 302 toward the second through hole 1024 so that the flat portion 3022 is confined by the second through hole 1024 and the restricting element 302 enters the restricting position. On the other hand, the axial displacement of the restricting element 302 and the connecting unit 101 is resulted from either pressing the lock body/operation device 20 in the first/unlocked status or a force provided by the elastic element 52 at a relative position. When the lock body/operation device 20 is in the unlocked/first status, pressing the unlocked lock body/operation device 20 will make the connecting unit 101 move toward the securing element 40 in the axial direction by means of driving of the driving device 30, so that the entering portion 1011 moves out through the first through hole 1023 and simultaneously moves along the extension portion 402, then finally selectively enters the lock hole. Meanwhile, the locking operation is accomplished while the lock body/operation device 20 is in the second status. When performing the unlocking operation, the force provided by the elastic element 52, which is disposed at the side of the connecting unit 101 opposite to the side adjacent to the driving portion 301, makes the connecting unit 101 and the components adjacent/connecting to the connecting unit 101 displace away from the securing element 40 in the axial direction, so that the entering portion 1011 selectively leaves the lock hole and simultaneously moves along the extension portion 402, then finally returns back to the cavity through the first through hole 1023; meanwhile, the lock body/operation device 20 is in the first status.

More specifically, when performing the unlocking operation to make the restricting element 302 leave the restricting position in the radial direction, the flat portion 3022 retreats into the cavity and is no longer restrained by the wall of the inner housing part 102. Meanwhile, the restricting element 302 presses the elastic element 51 to store elasticity. On the other hand, the elastic element 52 releases elasticity to drive the connecting unit 101 and the components adjacent/connecting to the connecting unit 101 to displace away from the securing element 40 in the axial direction, which consequently makes the entering portion 1011 selectively leave the lock hole and return back to the cavity through the first through hole 1023 so that the T-shaped structure can leave the lock hole to detach the lock structure from the electronic device after rotating the lock structure 10. On the other hand, the lock body/operation device 20 reverts to the first status. On the contrary, when pressing the lock body/operation device 20 in the first status, the connecting unit 101 displaces toward the securing element 40 in the axial direction so that the entering portion 1011 can exit through the first through hole 1023 and move along the extension portion 402 to extend out of the housing 100. In addition, when the connecting unit 101 moves to a degree allowing the opening 1012 of the trough to be aligned with the second through hole 1024 of the inner housing part 102, the elastic element 51 is able to release elasticity to make the restricting element 302 move toward the restricting position in the radial direction, so that the flat portion 3022 extends into the second through hole 1024 and is restrained by the wall of the inner housing part 102. As such, the locking operation is accomplished. At this time, the entering portion 1011 which selectively enters the lock hole is fixed in the lock hole due to the completion of locking operation; meanwhile, the lock structure 10 is unable to be rotated so that the securing element 40 cannot leave the lock hole; that is, the electronic device is secured.

Although the preferred embodiments of present invention have been described herein, the above description is merely illustrative. The preferred embodiments disclosed will not limited the scope of the present invention. Further modification of the invention herein disclosed will occur to those skilled in the respective arts and all such modifications are deemed to be within the scope of the invention as defined by the appended claims.

What is claimed is:

1. A lock structure for an electronic device with a lock hole, comprising:

a housing having a cavity and a first through hole, wherein the first through hole is formed on the housing to communicate with the cavity;

a securing element having a retaining portion and an extension portion, the retaining portion and the extension portion extending out of the housing through the first through hole and together forming a T-shaped structure, wherein the retaining portion has a length and a width in a radial direction of the extension portion, the length is greater than the width;

an entering portion capable of moving back and forth with respect to the housing and the securing element and parallel to an axis of the extension portion;

a driving device connecting to the entering portion to drive the entering portion to move back and forth, the driving device including a restricting element capable of displacing radially with respect to the movement of the entering portion and selectively located at a restricting position; and a lock body connecting to the driving device;

wherein when the lock body is in an unlocked status, the entering portion is moveable along the extension portion; when the lock body is in a locked status, the entering portion extends out of the housing and is fixed beside the extension portion and the restricting element is located at the restricting position.

2. The lock structure of claim 1, wherein the entering portion has a length along a direction perpendicular to an extending direction of the length of the retaining portion, and the length of the entering portion is greater than the width of the retaining portion.

3. The lock structure of claim 1, wherein the entering portion includes two separated columnar structures moveably positioned at two opposite sides of the extension portion, respectively.

4. The lock structure of claim 1, wherein the driving device connecting to the entering portion to drive the entering portion to move back and forth with respect to the housing and the securing element.

5. The lock structure of claim 1, wherein when the restricting element is at the restricting position, the entering portion extends out of the housing and is fixed beside the extension portion; when the restricting element is released from the restriction position, the entering portion is moveable along the extension portion.

6. The lock structure of claim 5, wherein the driving portion has a columnar structure with an elliptical cross section and a platform, and the platform is connected to the entering portion.

7. The lock structure of claim 6, the restricting element has a frame-like structure is movably fitted to the columnar structure with the elliptical cross section.

8. The lock structure of claim 7, wherein a longitudinal axis of the columnar structure with the elliptical cross section is perpendicular to a plane where the frame-like structure lies.

9. The lock structure of claim 7, wherein a flat portion is formed at one side of the frame-like structure and extends toward a direction; the restricting element selectively moves back and forth in the direction.

10. The lock structure of claim 1, wherein a second through hole is formed on the housing, the restricting element selectively corresponds to the second through hole and extends to the second through hole.

11. The lock structure of claim 10, further comprising a connecting unit, accommodated in the cavity, wherein the entering portion is disposed on the connecting unit, a trough is formed one side of the connecting unit opposite to the side having the entering portion disposed thereon, and the restricting element is moveably received in the trough.

12. The lock structure of claim 11, wherein the trough has an opening selectively aligned with the second through hole;

a part of the restricting element selectively extends to the second through hole from the opening.

13. The lock structure of claim 4, further comprising an operation device to drive the driving device.

14. The lock structure of claim 6, further comprising an operation device to drive the columnar structure with the elliptical cross section to rotate.

15. The lock structure of claim 1, wherein the driving portion is disposed on the lock body.

16. The lock structure of claim 13, wherein the operation device is disposed on the lock body.

17. The lock structure of claim 13, wherein the lock body serves as the operation device.

* * * * *